United States Patent [19]

Roldan

[11] Patent Number: 4,513,499

[45] Date of Patent: Apr. 30, 1985

[54] METHOD OF MAKING COMPLIANT PINS

[76] Inventor: Frank Roldan, 937 Paularino Ave., Costa Mesa, Calif. 92626

[21] Appl. No.: 441,405

[22] Filed: Nov. 15, 1982

[51] Int. Cl.[3] ..... H01R 43/00

[52] U.S. Cl. ..... 29/874; 339/221 M

[58] Field of Search ..... 29/882, 874; 339/252 P, 339/276 A, 221 M, 221 R; 72/324; 140/72

[56] References Cited

U.S. PATENT DOCUMENTS

| | | | |
|---|---|---|---|
| 3,071,844 | 1/1963 | Krause et al. | 29/882 X |
| 3,402,590 | 9/1968 | Kinkaid | 72/324 X |
| 3,545,080 | 12/1970 | Evans | 29/874 |
| 3,669,054 | 6/1972 | Dess et al. | 29/874 |
| 4,206,964 | 6/1980 | Olsson | 339/221 M |
| 4,230,384 | 10/1980 | Anhalt | 339/252 P X |

*Primary Examiner*—Howard N. Goldberg
*Assistant Examiner*—Carl J. Arbes

[57] ABSTRACT

The dimensions of the compliant segment of a compliant pin are carefully controlled, so that upon being inserted into a hole in a circuit board the pin fits snug within the hole, but avoids the use of excessive force which could damage the copper sheathing of the hole. Prior to the pin being inserted into the hole, the compliant segment, which comprises a pair of beam members separated by an opening, has a width measured across its widest part that exceeds the maximum acceptable hole diameter by at least 0.005 inch. When inserted into the hole, the beams abut each other and the compliant segment has a width measured across any part thereof which is equal to the minimum acceptable hole diameter within a tolerance of ±0.001 inch. This pin is made from a generally flat strip of metal material which is severed to form therein a pair of metal pieces from which the beam members are made. These beam members are separated to form the opening, with the separation being carried out by inserting between the metal pieces a spreader element which is moved towards and then away from the strip generally at a right angle with respect to the plane of the strip. When the pieces are formed, they move in opposite directions away from the plane of the strip. Theses pieces are flattened either prior to separation or simultaneously with separation, so that they are returned to a position which is in the plane of the strip of metal material.

3 Claims, 41 Drawing Figures a
k
m
6b
6c
6d
6e
6f
6g,h,i,j

METHOD OF MAKING COMPLIANT PINS

BACKGROUND OF THE INVENTION

1. Field of the Invention

This invention relates to a printed circuit board pin. More specifically, the invention relates to a printed circuit board pin having precise dimensions which enable the pin to be inserted into and held securely within the board without damaging the board.

2. Discussion of Prior Art

Printed circuit board pins are common devices which are inserted into a hole in a printed circuit board. After the pin has been inserted, a portion of the pin, referred to as the post, extends outwardly from one surface of the printed circuit board. This post has a rectangular cross-section, and wire is wrapped around it to connect one pin to another pin.

A typical circuit board pin is illustrated in U.S. Pat. No. 4,206,964. The pin shown in U.S. Pat. No. 4,206,964 is made from a flat strip of metal, for example, copper. It includes a shoulder segment which has a width substantially wider than the maximum acceptable diameter of the hole, a post segment which has a width substantially less than the minimum acceptable diameter of the hole, and a compliant segment between the shoulder and post segments and integral therewith. The compliant segment has a pair of outwardly-biased beam members separated by an elongated opening having sharply pointed ends. One end is adjacent the shoulder segment and the other end is adjacent the post segment. When the pin is inserted into the hole, the beams, which act as springs, are compressed inwardly towards each other reducing the size of the opening.

The hole into which the pin is inserted has a copper sheathing which is basically a tubular element having flanges on opposed ends which abut the surfaces of the printed circuit board and retain the sheathing within the hole. This sheathing is very fragile. If the compliant segment is extruded when it engages the sheathing, excessive forces develop which in many instances result in rupture of the sheathing.

SUMMARY OF THE INVENTION

I have invented a compliant pin for a printed circuit board which is designed to avoid damaging the copper sheathing when the pin is inserted into the hole in the printed circuit board. I have also invented a method of mass-producing these pins, while retaining the precise dimensions of the pins which are required in order for the pin to perform as desired.

Like the pins of the prior art, the pin of this invention has a shoulder and a post segment joined together by a compliant segment having a pair of outwardly-biased beam members. The pin of this invention is, in part, characterized in that (a) prior to insertion of the pin into the hole, the widest part of the compliant section exceeds the maximum acceptable hole diameter by at least 0.005 inch, and, (b) when the beams are abutting each other, they have a combined width measured across any part which is equal to the minimum acceptable hole diameter within a tolerance of ±0.001 inch. Because the widest part of the compliant section exceeds the hole diameter by at least 0.005 inch, retention of the pin upon insertion in the hole is insured.

The compliant segment has a core which is integral with the post, with the beam members extending outwardly from the base of the core. The maximum core width is at the junction between the beams and the core along the base of the core. This width is equal to the minimum acceptable diameter of the hole within a tolerance of ±0.001. In accordance with this invention, the compliant section is neither so wide that the force to insert the pin into the hole exceeds about 30 pounds nor so narrow that the push out force to remove the pin from the hole is less than about 12 pounds.

The prior art pins disclosed in U.S. Pat. No. 4,206,964 are made by severing the strip to form therein a pair of metal pieces from which the beams are made and then separating the metal pieces to form the opening. This prior art method calls for pushing laterally against the pieces which lie above and below the plane of the strip. After the pieces are so separated, they are flattened so that they both lie in the plane of the strip. In accordance with this invention, the spreading of the pieces is accomplished by inserting between them a spreader element which is moved towards and then away from the strip generally at a right angle with respect to the plane of the strip. More specifically, the method for making the pin of this invention comprises the following steps:

(a) cutting generally spaced-apart aligned windows in a strip of metal so that a solid section is provided between adjacent pairs of windows, with the compliant segment of the pin being formed from this solid section, (b) severing the solid section generally at right angles with respect to the longitudinal axis of the strip to form in the solid section the pair of metal pieces from which the beam members are made, one of the pieces moving in one direction away from the plane of the strip and the other piece moving in the opposite direction away from the plane of the strip, (c) inserting between the metal pieces the spreader element which moves generally at a right angle with respect to the plane of the strip to form the opening in the complaint segment, (d) flattening the metal pieces so that they are generally in the plane of the strip, and (e) forming from the strip, integral with the metal pieces, the shoulder and post segments of the pin.

The opening forming and flattening steps may be carried out simultaneously or the flattening step may be carried out prior to the opening forming step. Preferably, the solid section is coined subsequent to the flattening step. Coining increases the spring strength of the beams and rounds sharp edges which could cut through the sheathing. Both the external and internal edges of the beam members are preferably coined in order to maximize the spring strength of these members. In the most preferred way of practicing the above method, the two pieces are twisted prior to the insertion of the spreading element so that there is provided a generally V-shaped entryway between the pieces into which the spreader element is inserted.

The present invention has several advantages. It may be mass produced at relatively low cost. Notwithstanding being mass produced, its dimensions are precisely maintained. Precision design and manufacture of the pin provides a nose in the compliant segment of the pin which does not plow through the sheathing or be excessively extruded upon the compliant section engaging the copper sheathing. The working stations within the dies used in manufacturing the pins generally move into and away from the plane of the copper strip. Consequently, the manufacturing equipment is easy to build, operate, and maintain.

These advantages and other features of the present invention can best be understood by reference to the following description, taken in connection with the drawing in which like numerals indicate like parts.

DETAILED DESCRIPTION OF THE DRAWING

The Pin

Figures 1, 4, 5, 12, 13:
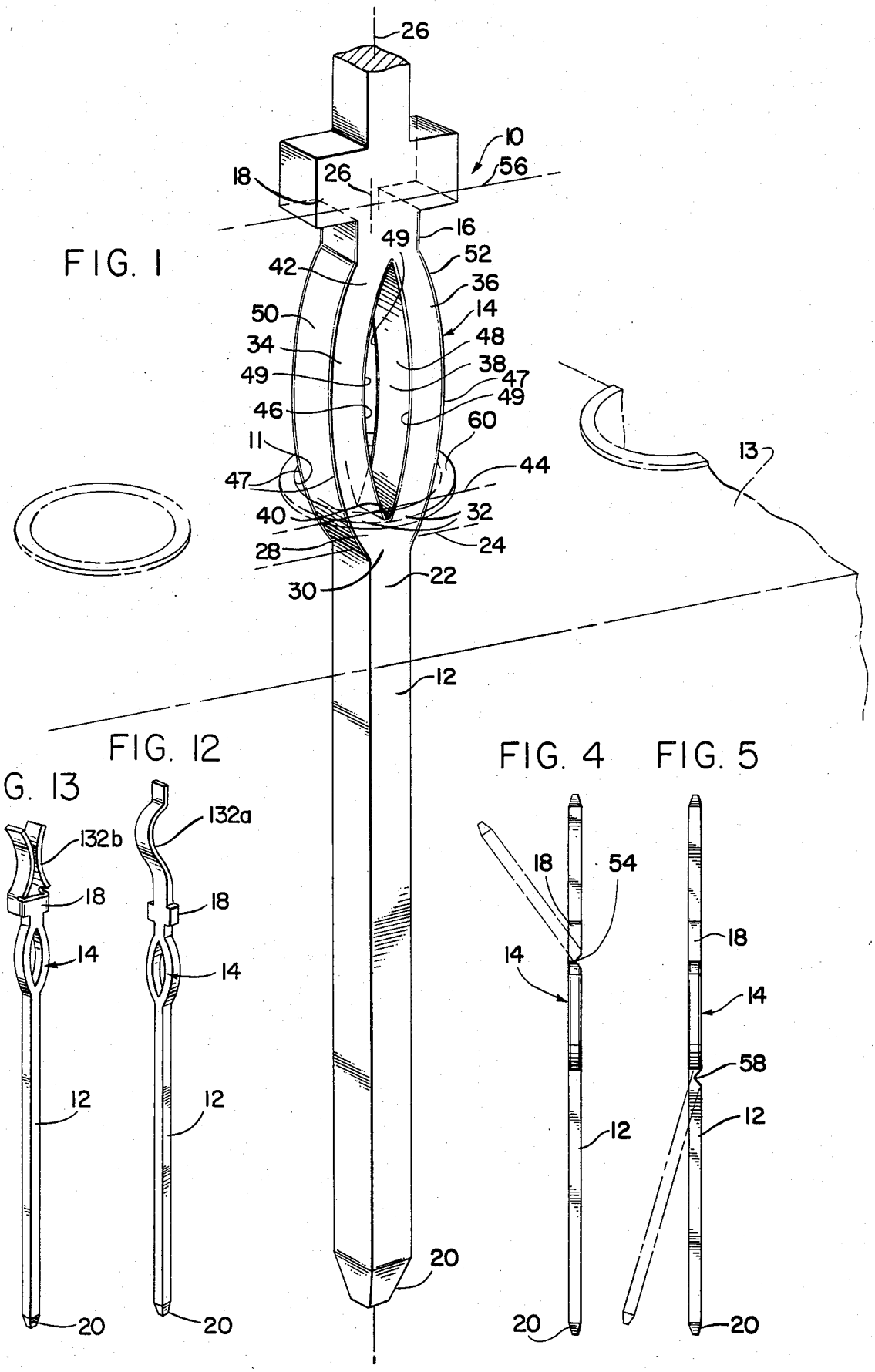
FIG. 1 is a perspective view of the compliant pin of this invention being inserted into a hole in a printed circuit board.
FIG. 4 is a side elevational view of a second embodiment of the pin of this invention.
FIG. 5 is a side elevational view of a third embodiment of the pin of this invention.
FIG. 12 is a perspective view showing a third embodiment of the pin of this invention.
FIG. 13 is a perspective view showing a fourth embodiment of the pin of this invention.

As shown in FIGS. 1 through 3*b*, the contact pin 10 of this invention is inserted into a hole 11 in a printed circuit board 13. Copper sheathing 60 covers the inside surface of the hole. Typically the copper sheathed hole has an established industry standard diameter ranging between about 0.037 and about 0.043 inch. The hole's depth varies depending on the thickness of the board 13.

The pin 10 includes an elongated post 12 having a rectangular cross-section, a compliant segment 14, a neck 16, and a shoulder 18. The post 12 has a tapered end 20. The post length will vary, for example, between about 0.000 and about 1 inch. The end 22 of the post opposite the tapered end 20 is integral with the compliant segment 14. The junction between the post and the compliant section is indicated by the junction line 24 (FIG. 1), which is generally at 90° with respect to the longitudinal axis 26 of the pin.

Figure 3A:
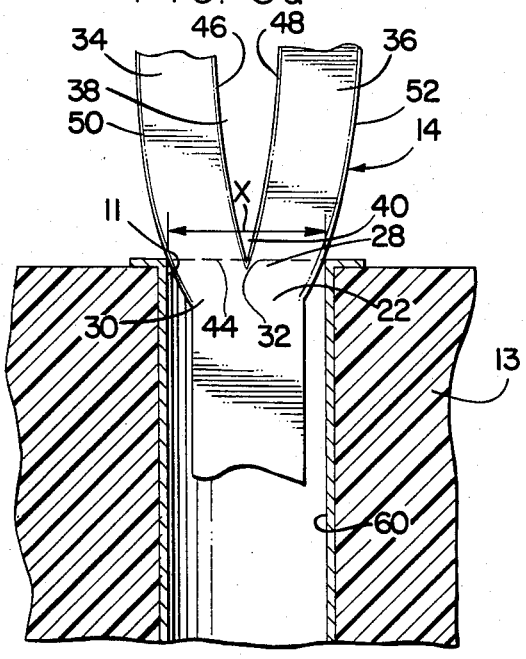
FIG. 3*a* shows the compliant segment of the pin entering the hole with the base of the nose of the compliant section engaging the perimeter of the sheathing.
Figure 3B:
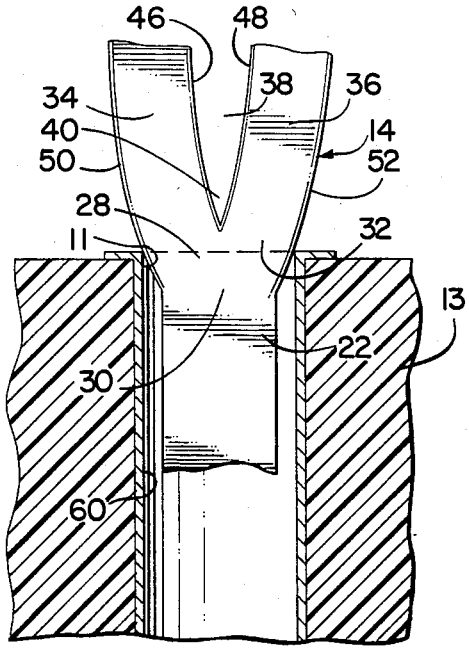
FIG. 3*b* shows a pin wherein the base of the core is significantly wider than the diameter of the hole.

The compliant segment 14 has a core 28 including a nose 30 integral with the post along the junction line 24 and a base 32 from which a pair of beams 34 and 36 extend. Each beam has a rectangular cross-section. As best shown in FIG. 3*a*, the width x of the base 32, the widest part of the core 28, is equal to the minimum acceptable hole 11 diameter within a tolerance of ±0.001 inch. The length of the core will be about 0.013 inch. The sides of the core 28 are tapered inwardly so that the nose 30 of the core has a width equal to the width of the post 12, which will be substantially less than the minimum acceptable hole diameter.

The beams 34 and 36 are biased outwardly and separated by an elongated opening 38 which extends along the longitudinal axis 26 of the pin. This opening 38 has sharply pointed opposed ends 40 and 42 disposed on the axis 26, with the one end 40 on a junction line 44 (FIG. 3*a*) which is generally at 90° with respect to the longitudinal axis 26 and intersects the base 32 of the core. The beams 34 and 36 are bowed to provide convex external surfaces, with the widest portion of the compliant section being about midway between the pointed ends 40 and 42. This widest portion is substantially greater than the maximum acceptable hole diameter, but is neither so wide that the insertion force exceeds about 30 pounds nor so narrow that the push out force is less than about 12 pounds. The arcs of the inner wall 46 and outer wall 50 of the beam 34 are identical and the arcs of inner wall 48 and outer wall 52 of the beam 36 are identical so that these walls are parallel as shown. The external edges 47, and preferably both the external edges and internal edges 49, of the beams are rounded, as will be explained in detail below, by coining. Coining enhances the strength of the beams, increasing the spring force of the beams, and provides smooth surfaces which will not cut into the copper sheathing 60.

Figure 2A:
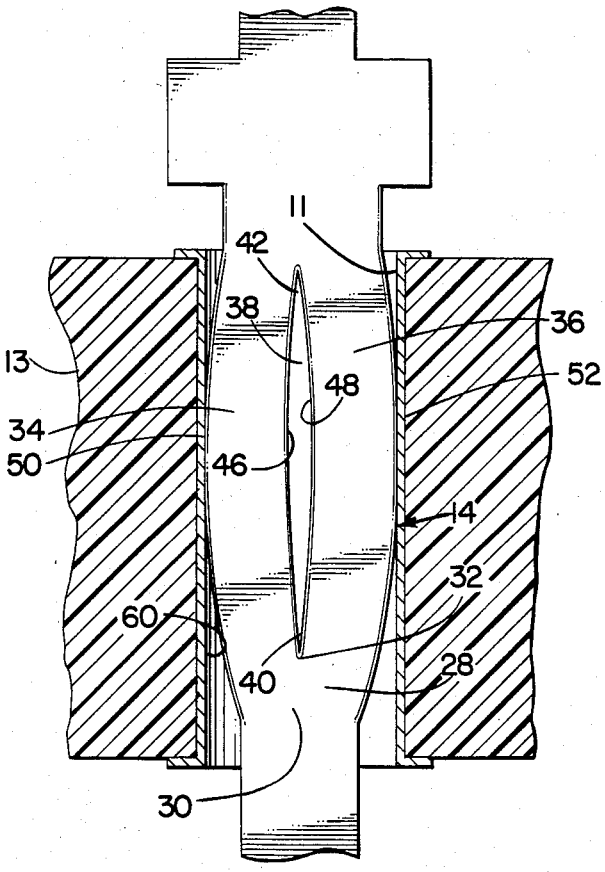
FIG. 2*a* shows the pin inserted into a printed circuit board hole which has the maximum hole diameter.
Figure 2B:
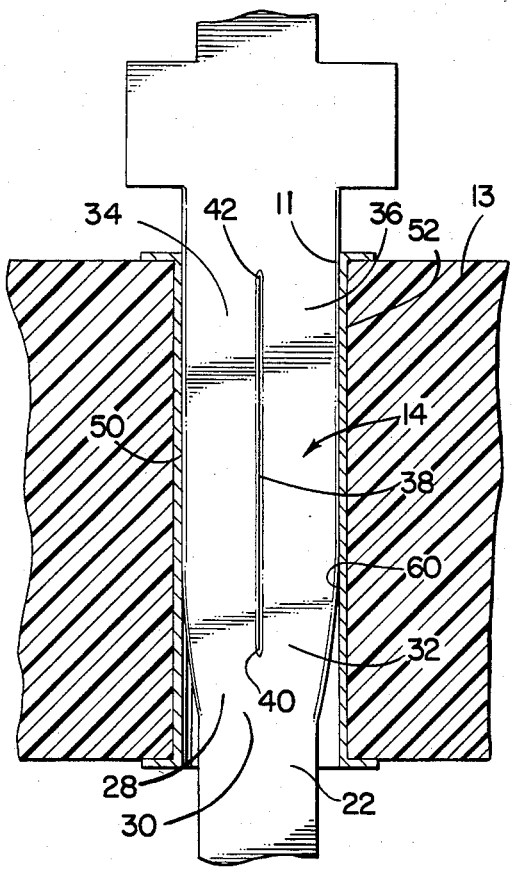
FIG. 2*b* shows the pin inserted into a printed circuit board hole which has the minimum hole diameter.
Figures 6A, 6B, 6C, 6D, 6E:
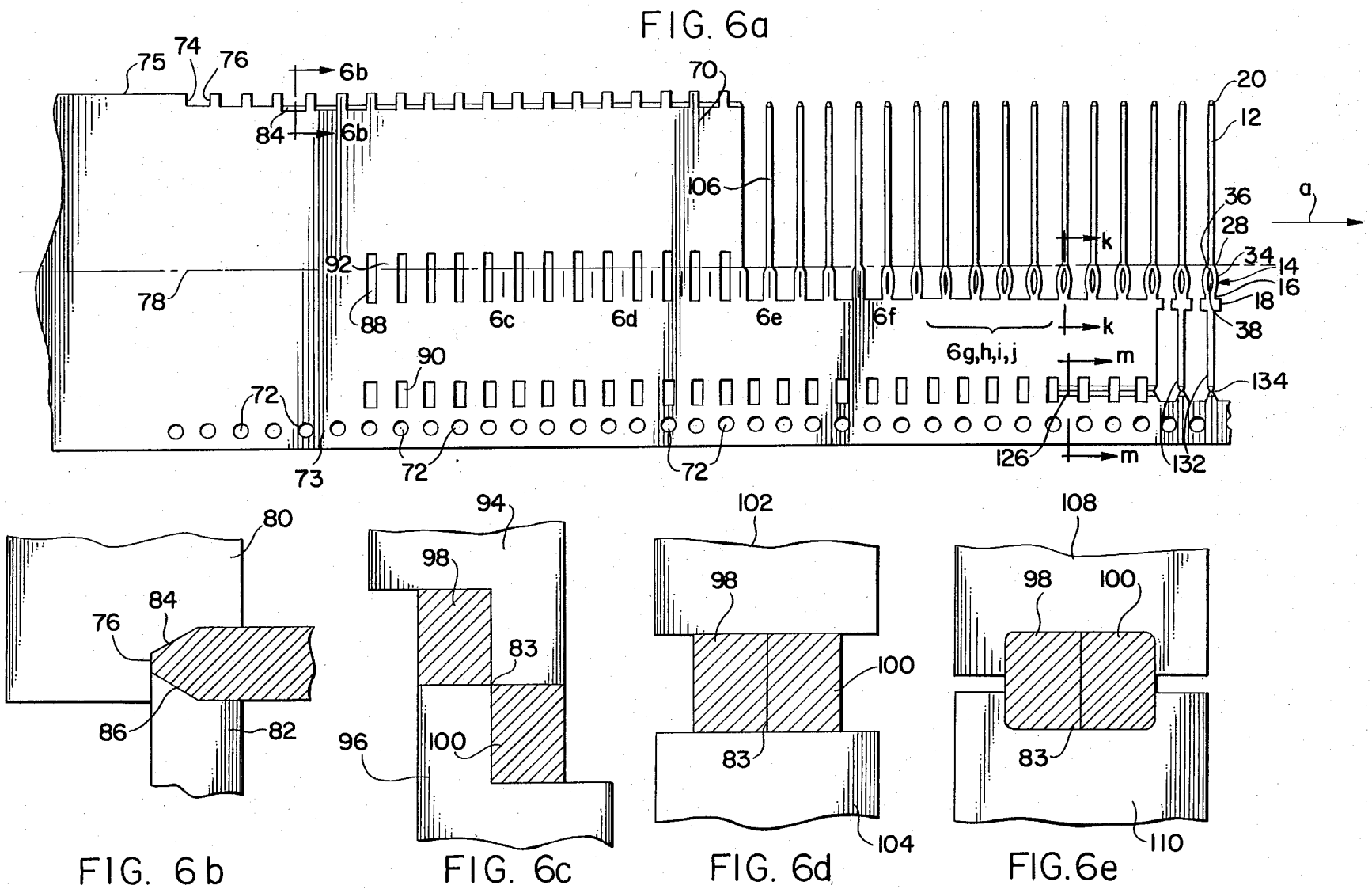
FIG. 6*a* is a plan view of a strip of metal from which sections have been cut as the strip of metal moves past various work stations of the punching apparatus used to make the pins.
FIGS. 6*b* through 6*n* illustrate schematically various work stations past which the strip moves. The positions of these work stations relative to the strip are generally indicated by cross-sectional lines on the strip shown in FIG. 6*a*.
Figure 6H:
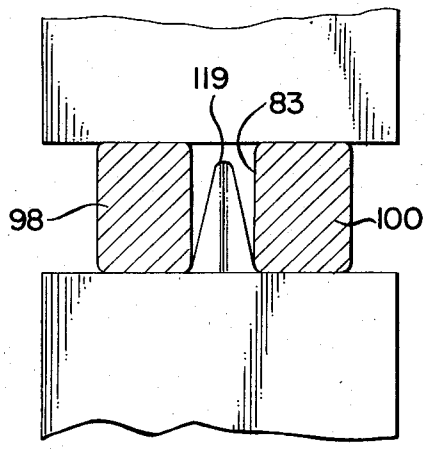
Figure 6G:
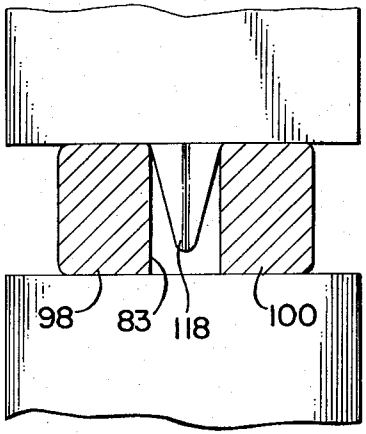

The neck 16 is disposed between the shoulder 18 and compliant segment 14 and is integral therewith, having a width slightly less than the minimum acceptable hole diameter. This neck provides a spacing or offset between the compliant segment and the shoulder. As illustrated in FIGS. 2*a* and 2*b*, this permits the pin 10 to be inserted in the hole 11 in the circuit board with the shoulder slightly above the top surface of the board. Above the shoulder is an upper contact segment 132 (FIG. 6*a*) of any conventional design. FIGS. 12 and 13 illustrate two different embodiments of the upper segment. FIG. 12 shows a cantilever segment 132*a* and FIG. 13 shows a dual beam segment 132*b*.

The pin 10 must be correctly inserted into the board in order for the post 12 to be correctly wrapped with wire. If the core 28 or beams 32 and 34 of the compliant segment 14 extended substantially outwardly from the bottom side of the board, this would prevent the post 12 from being wrapped correctly by automatic wire wrapping equipment. Thus, when the pin 10 is inserted into the printed circuit board 13 in accordance with standard industry practices, the compliant segment does not extend substantially from the printed circuit board, either from the top side or bottom side of the board. When thinner printed circuit boards are employed, however, the core 28 of the compliant segment may protrude slightly from the bottom side of the board provided it does not interfere with wire wrapping.

In accordance with an optional feature of this invention, the pin 10 may have a groove 54 in it along the junction line 56 between the shoulder and neck. This is illustrated in FIG. 4. The purpose of this groove is to permit one to bend and break off upper segment 132 after the pin has been inserted into the circuit board 13. Ordinarily this would be done by inserting the pin so that the shoulder 18 rests against, or is just slightly above, the top side of the circuit board and then bending it to the dotted position shown in FIG. 4.

In accordance with another optional feature of this invention as shown in FIG. 5, the post 12 includes a groove 58 running perpendicular to the longitudinal axis of the pin and near the nose of the core. This groove 58 permits the post 12 to be broken off if desired. Again, the pin 10 would be inserted into the hole 11 such that the shoulder would be just about, or exactly, flush against the top side of the circuit board. Typically the relationship of the opening 38 length, core length, and neck length is such that with the pin inserted into the board in this fashion, the nose 30 of the core 28 will be just about flush with the bottom side of the circuit board. One would then bend the post about the groove, moving it to the dotted position shown in FIG. 5, to break off the post 12.

As best shown in FIG. *3a*, when the compliant segment 14 of the pin enters the top of the hole 11, the nose 30 of the core 28 penetrates into the hole, and then the base 32 of the core engages the copper sheathing 60 of the hole. This sheathing 60 is a relatively fragile structure which will rupture if the insertion force is excessive. This force will be excessive if it is necessary to substantially extrude the core 28 prior to compressing the beams inwardly. This will occur if the base 32 of the core is not essentially flush with the top of the sheathing 60 as the outer walls 50 and 52 of the beams come into engagement with the sheathing 60. In accordance with this invention, the width of the base is equal to the minimum diameter of the hole within a tolerance of ±0.001 inch. Consequently, as soon as the base 32 of the core engages the perimeter of the hole, the beams begin to flex inwardly and the core is not extruded to any significant degree.

If the length of the opening 38 is not precise, the critical width of the base 32 will not be maintained. This is illustrated in FIG. *3b*. When the length opening is too long, the beams 34 and 36 will expand outwardly to an excessive degree. The more they expand outwardly, the greater the width of the base 32 of the core. When the base width expands much beyond the tolerance of 0.001 inch, the outer walls 50 and 52 engage the sheathing 60 prior to the base 32 reaching the top of the hole 11. Consequently, excessive beam extrusion occurs which may damage the sheathing 60. Because the maximum width of the base 32 is carefully controlled, extrusion is avoided altogether, or minimized, so that the sheathing 60 is not ruptured.

FIGS. *2a* and *2b* show the pin 10 inserted into holes of differing diameters. In FIG. *2b* the pin is inserted into a hole having the minimum acceptable hole diameter, typically 0.037 inch. FIG. *2a* shows the pin inserted into a hole of maximum acceptable hole diameter, typically 0.043 inch. The dimensions of a typical pin, along with tolerances, are presented below in Table I.

TABLE I

| | Dimension | Tolerance |
|---|---|---|
| Pin Thickness | 0.025 | ±.001 |
| Shoulder Width | 0.060 | ±.003 |
| Shoulder Height | 0.045 | ±.003 |
| Neck Width | 0.036 | ±.001 |
| Neck Height | 0.020 | ±.001 |
| Compliant Segment Width At Widest Part Prior To Insertion | 0.050 | ±.002 |
| Opening Length | 0.090 | ±.005 |
| Core Base Width | 0.036 | ±.001 |
| Post Width | 0.025 | ±.001 |

A series of pins meeting the specification set forth in Table I were tested using industry standard testing procedures to determine the force required to insert these pins into and push them from holes having diameters ranging between 0.037 to 0.043 inches. The test equipment used was a Chatillon gauge distributed by the Empire Scale Company of Los Angeles, Calif. mounted on a stand having an adjustable platform. The stand is made by the Ametex Co., Hunter Spring Division, of Hatfield, Pa. Individual pins are placed in the hole of a circuit board and, by means of a fixture and jig, the pin is forced into or from the hole by raising the platform. The needle on the gauge provides an indication of the force being exerted against the pin. During insertion, the needle continues to move across a calibrated scale until the beams begin to deflect inwardly once the force is sufficient to overcome the spring force of the beams. At this point, the needle stops opposite the number corresponding to the insertion force. The same procedure is used to push the pin from the hole to measure the push out force.

Figure 11:
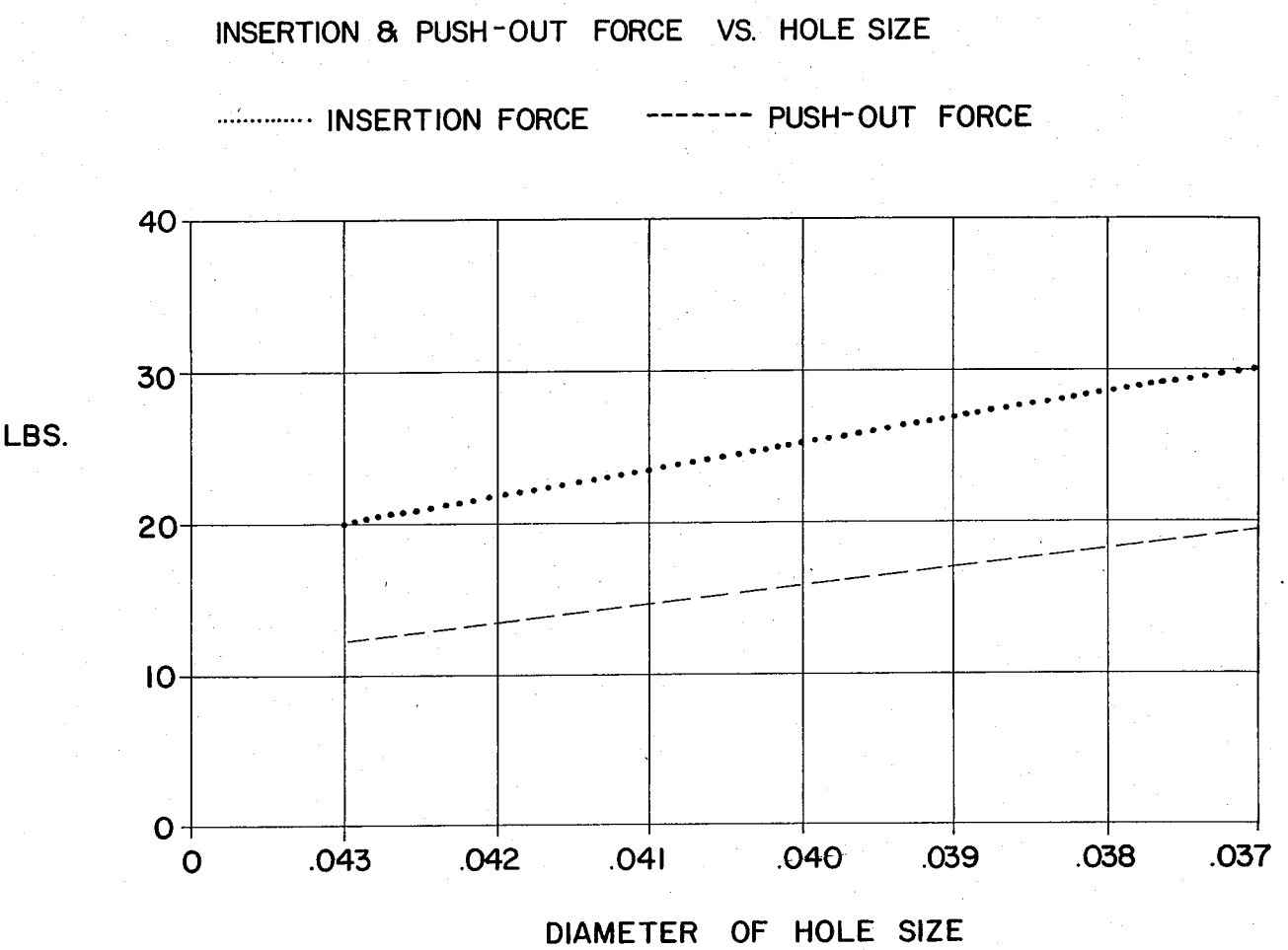
FIG. 11 is a graph depicting the insertion forces and the push out forces for pins inserted and withdrawn from holes of varying diameters.

In accordance with an important feature of this invention, the beams of the pin 10 are designed so that the maximum insertion force is about 30 pounds and the minimum push out force is about 12 pounds for hole diameters of 0.040 inch within a tolerance of ±0.003 inch. This feature of the invention is graphically illustrated in FIG. 11 which shows the insertion forces and push out forces of the pins specified in Table I in holes having diameters ranging between 0.037 and 0.043 inch.

Methods of Making the Pin

As shown shown in FIGS. *6a* through *6n*, the pin 10 of this invention is manufactured from a flat strip 70 of metal such as, for example, copper, brass, bronze, and the like. The strip 70 has a thickness of 0.025 inch within a tolerance of ±0.001, and a width which depends on the desired configuration of the pin.

The strip 70 moves past a series of work stations in a punching apparatus (not shown). The first work station punches a hole 72 in the edge of the strip. A finger element (not shown) in the punching apparatus is inserted into this hole and pushes the strip in the direction indicated by arrow a to advance the strip in a stepwide fashion through the apparatus. Thus, a series of holes 72 are formed in the one side 73 of the strip.

The second work station cuts an indentation 74 in the other side 75 edge of the strip. This indentation 74 has an edge 76 which is generally parallel to the longitudinal axis 78 of the strip. When the strip is moved to the next work station, this edge is coined as illustrated in FIG. *6b* by pressing it between shearing stations 80 and 82. The coining operation forms bevels 84 and 86 which are two of the five surfaces of the tapered end 20.

The third work station to which the strip advances cuts a pair of windows 88 and 90 in the strip. One window 90 is adjacent a hole 72 and the other window 88 lies in the middle section of the strip adjacent its longitudinal axis 78. As the strip advances through the punching apparatus, there is a solid section 92 between adjacent pairs of the windows 88. The compliant segment 14 of the pin is made from this solid section 92.

One of the most important and critical steps of the manufacturing operation is the severing of the solid section 92. This is accomplished at the fourth work station where a pair of carbide members 94 and 96 slice the solid section at about its center along a line which is perpendicular to the axis 78 to form a slit 83 therein. As the members 94 and 96 engage the strip one piece 98 of the strip moves up and away from the plane of the strip, while the other piece 100 moves in the opposite direction down and away from the plane of the strip. The length of this slit is carefully controlled and corresponds to the length of the opening 38. If it is too long or too short the base 32 of the nose will not have the critical tolerance discussed above.

After severing the solid section 92, the sheet advances to the fifth work station which flattens the solid section as illustrated in FIG. *6d*. Flattening simply consists of pressing the two pieces 98 and 100 together so that they return to the plane of the strip. This is accomplished by inserting the strip between two die elements 102 and 104 which move towards each other.

After the solid section has been flattened, the strip advances to the fifth work station, a cutting station (not shown). At the cutting station, the compliant segment 14 and post 12 are formed by cutting away excess metal from the strip. This is illustrated by the partial formation 106 of the pin shown in FIG. *6a*. This cutting operation is accomplished by a cutter moving generally at right angles to the plane of the strip towards and through the strip and then reversing direction to move away from the strip.

After cutting to make the partial formation 106, the strip is advanced to the sixth work station where the outer edges 47 of the compliant section are coined or rounded as illustrated in FIG. *6e*. This is accomplished by simply pressing the compliant section between a pair of generally U-shaped die elements which compress the edges 47 of the compliant section 14 to round them as shown.

After coining, the strip is advanced to the seventh work station which consists of a pair of mating V-shaped die elements 112 and 114. The bight of the V of the lower die element 114 engages the underside of the strip opposite the slit 83. When the die elements come together, they force the pieces 98 and 100 to twist to form the butterfly configuration as illustrated in FIG. *6f*. The butterfly configuration provides a spacing 116 between the pieces 98 and 100.

With the pieces spread to provide the spacing 116, the sheet then advances past a series of four work stations illustrated in FIGS. *6g* through *6k*. These work stations, the eighth, ninth, tenth, and eleventh, each consist of separating blades 118, 119, 120 and 121 which are inserted into the slit 83. At the eighth work station illustrated in FIG. *6g*, the upper spreader blade 178 is inserted into the spacing 116 of the butterfly. As the die elements move together, the pieces 98 and 100 are spread apart to form the opening 38 between the beams 34 and 36 of the pin. This spreading operation is repeated at the ninth work station with the spreader blade 119 being inserted into the underside of the strip into the slit 83. The spreading operation is again repeated by passing the strip through the tenth and eleventh work stations which respectively insert the spreading blades 120 and 121 from both above and below the plane of the strip into the slit 83. The inside edges 49 of the beams are rounded and coined by the insertion of the spreading blades into the slit.

Since it is critical that the compliant section, prior to insertion in the hole, have dimensions which at the widest part of the compliant section exceeds the maximum acceptable hole diameter by at least 0.005 inch, the pins being manufactured are checked to see if they comply with this standard. If they fail to have the desired width, an adjuster element 122, illustrated in FIGS. *6k* through *6m*, is inserted into the slit 83 at the twelfth work station. It consists simply of a spreader blade 123 mounted on a support 124 which can be raised or lowered by means of a set screw 125. If the width of the compliant section at its widest point does not exceed 0.005 inch, the spreader blade 123 is lowered and inserted into the slit 83 to spread the pieces 98 and 100 further apart. The spreader blade is lowered as required so that the compliant section will have the desired width.

As shown in FIG. *6n*, the thirteenth work station consists in forming V-shaped upper and lower grooves 126 and 128 in the strip between adjacent pairs of the windows 90. These grooves 126 and 128 are spaced apart and provide a slender metal section 130 which holds the pin to the strip after the final cutting operation. This final cutting operation is illustrated by formation of the pin 10 which has the shoulder 18 from which the upper contact segment 132 attached to the edge of the strip by the section 130 (FIG. *6n*). This upper segment 132 will have a tapered end 134 formed in part by the V-shaped grooves. The pin is removed from the strip by breaking the metal section 130.

Several other ways of making the pin are discussed below. The principal difference between these ways and the method illustrated in FIGS. *6a* through *6n* is the manner in which the compliant segment is formed. These methods shall now be discussed.

In accordance with the method illustrated in FIGS. *7a* through *7e*, the solid section 92 is severed as illustrated in FIG. *7a* to form the pieces 98 and 100 and slit 83. Then the strip is flattened as illustrated in FIG. *7b*. Instead of forming the butterfly, pointed spreader elements 136 and 138 is simply inserted into the slit 83 to spread the pieces apart. As illustrated in FIGS. *7c* and *7d* first the upper element 136 from the topside of the sheet is inserted into the slit, then at the next work station element 138 is inserted from the underside of the sheet into the slit. After the spreading operation, the pieces are coined as illustrated in FIG. *7e* to round the edges of both the inner and outer walls of these pieces.

Figure 8A:
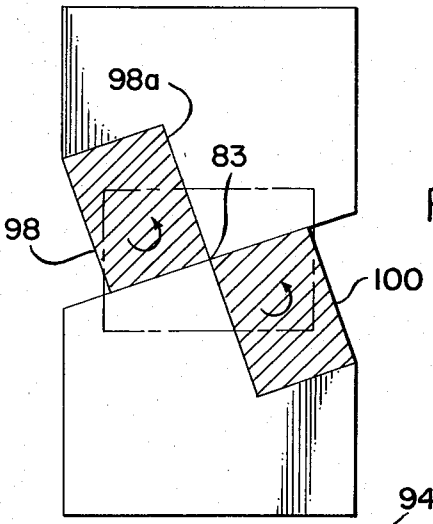
FIGS. 8*a* through 8*c* illustrate a third way of making the pin of this invention.
Figure 8C:
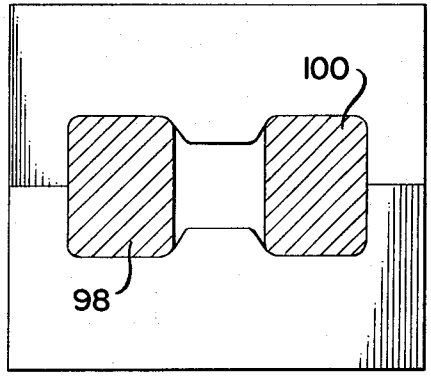
Figure 7E:
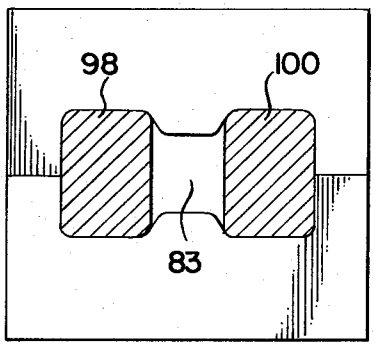
Figure 8B:
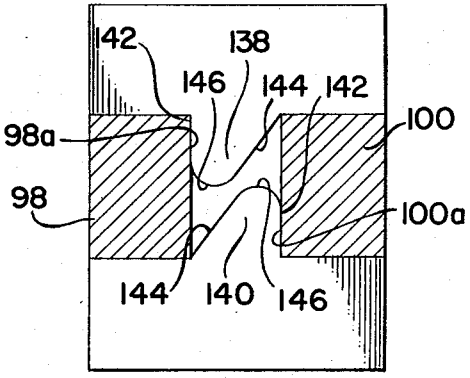

FIGS. *8a* through *8c* illustrate a third way of making the pin of this invention. In accordance with this method, the solid section 92 is severed on a bias as illustrated in FIG. *8a* to twist the pieces 98 and 100 counter clockwise as indicated by the arrows. Next, the compliant section is both flattened and spread simultaneously as illustrated in FIG. *8b*. At this work station a die element is used having a upper and lower section including spreading elements 138 and 140 which are complementary. Each element includes a vertical side 142 and a tapered side 144 converging into a pointed edge 146. The pointed edges 146 of these elements are offset with respect to each other. Consequently, as the upper and lower sections come together, the pointed edge 146 of the element 138 will engage the side 98*a* of the piece 100 and the pointed edge 146 of the element 140 will engage the side 100*a* of the piece 100. As the die station continues to move towards each other, this forces the pieces 98 and 100 away from each other and at the same time twists the pieces in a clockwise direction as viewed in FIG. 8*a*. Thus, when the upper and lower sections of the die are in the position shown in FIG. 8*b*, the pieces are both flattened and spread apart. FIG. 8*c* simply illustrates coining of the pieces to round the edges of the inner and outer walls of the beams.

Figure 6F:
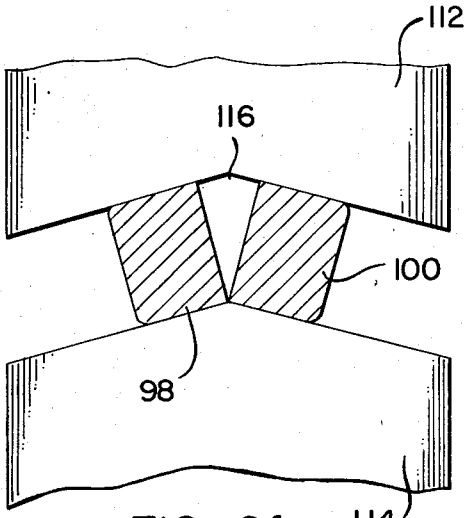
Figure 6K:
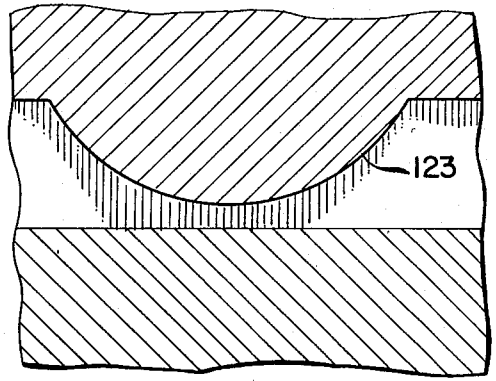
Figure 6J:
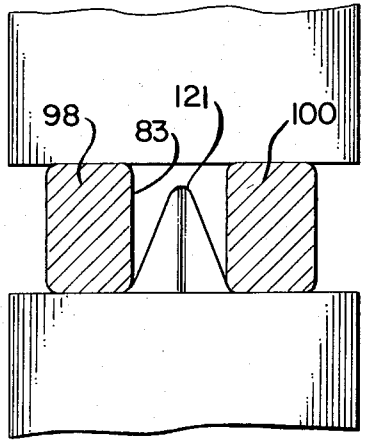
Figure 6I:
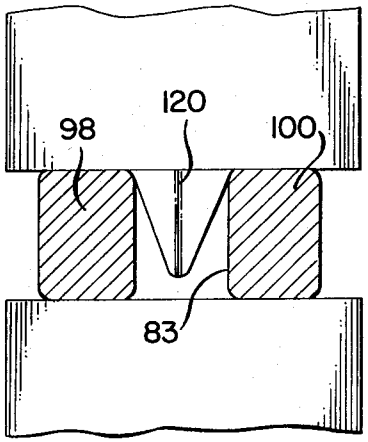
Figure 6N:
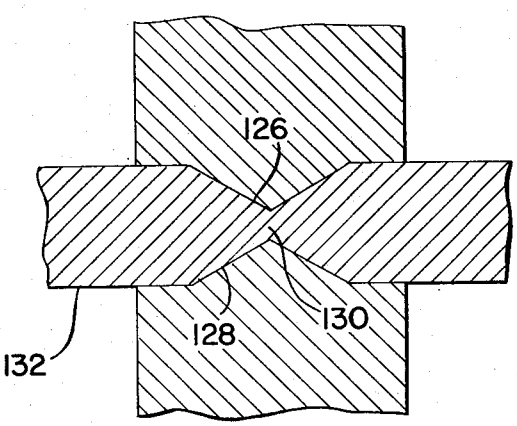
Figure 6M:
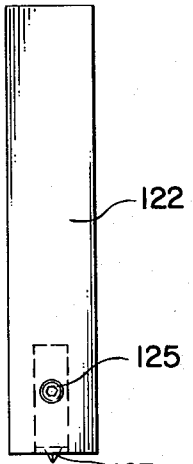
Figure 6L:
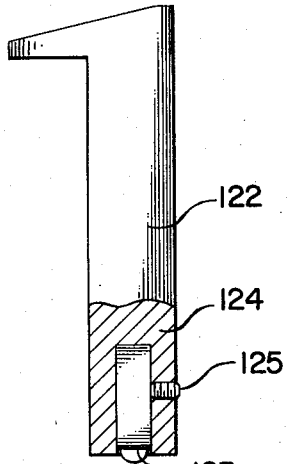
Figure 7D:
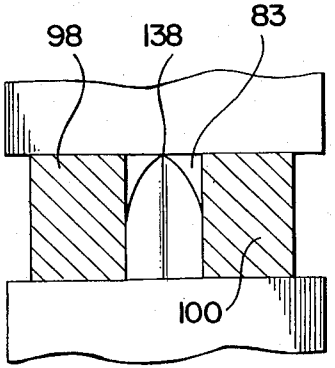
FIGS. 7*a* through 7*e* illustrate schematically a second way of making the pin of this invention.
Figure 7C:
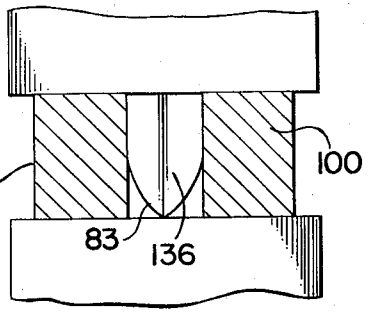
Figure 7B:
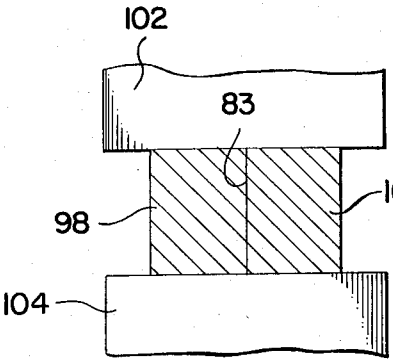
Figure 7A:
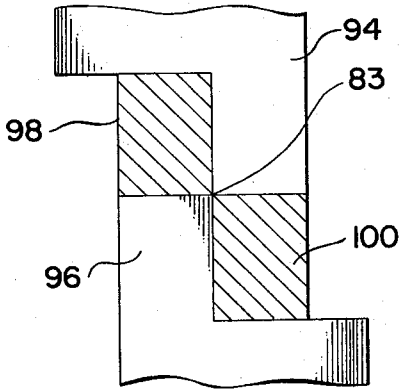
Figure 9A:
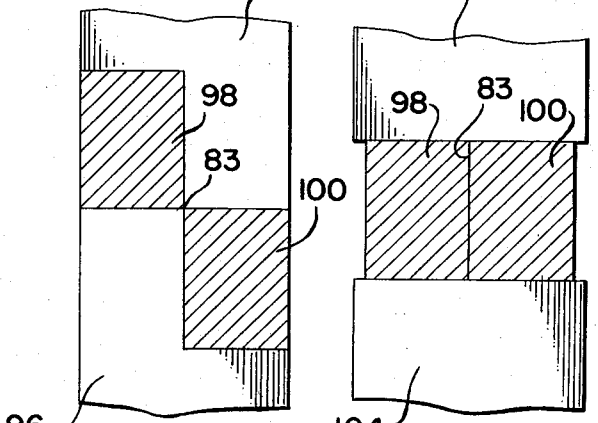
FIGS. 9*a* through 9*e* illustrate a fourth way of making the pin of this invention.
Figure 9B:
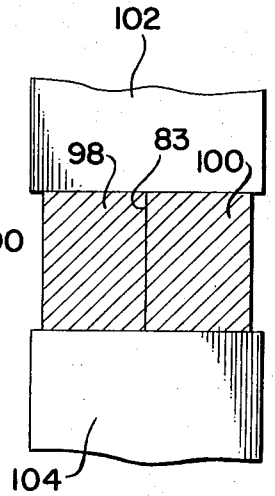
Figure 9E:
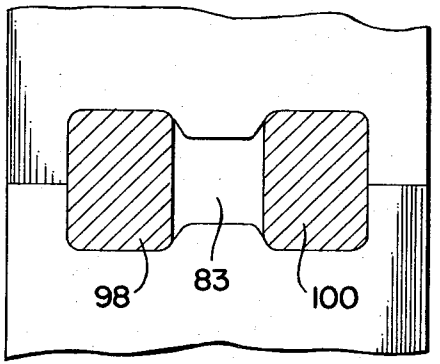
Figure 9D:
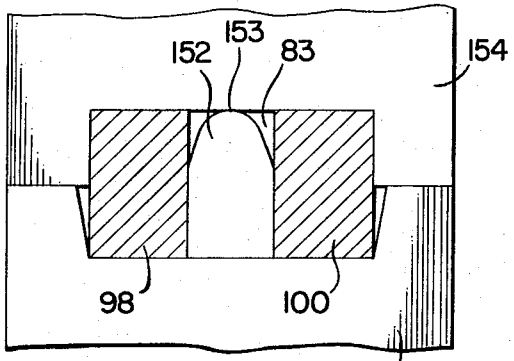
Figure 9C:
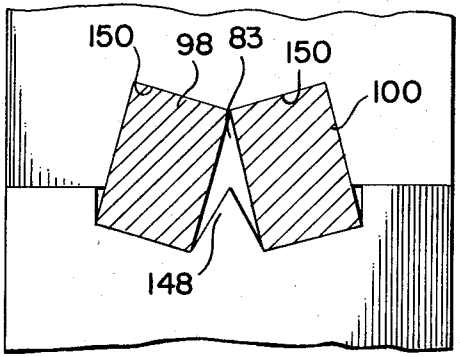

FIGS. 9*a* through 9*e* illustrate a fourth way of making the pin of this invention. In this embodiment, the pieces 98 and 100 are formed by severing as illustrated in FIG. 9*a* and then flattened as illustrated in FIG. 9*b* in the same manner as discussed in connection with FIGS. 6*c* and 6*d*. As illustrated in FIG. 9*c*, the pieces 98 and 100 are separated to form a butterfly configuration similar to that illustrated in FIG. 6*f*. A slightly different member is used in this embodiment than that shown in FIG. 6*f*. Here the lower sections includes an upwardly pointing wedge 148 which is inserted into the slit 83. The upper section has recess 150 which receives the tops of the pieces 98 and 100. Next, a separating and flattening die element is illustrated in FIG. 9*d* wherein a relatively large element 152 having a rounded edge 153 is inserted into the slit 83 as the upper and lower sections 154 and 155 move together. This both separates and flattens the pieces 98 and 100. FIG. 9*e* again illustrates coining of the pieces.

Figure 10D:
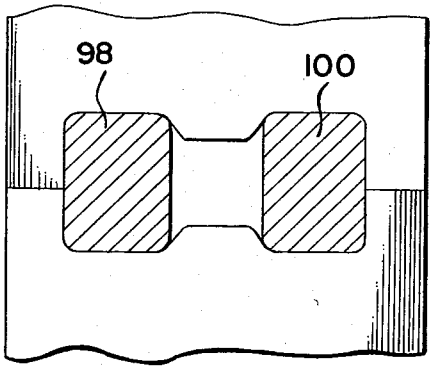
FIGS. 10*a* through 10*d* illustrate a fifth way of making the pin of this invention.
Figure 10C:
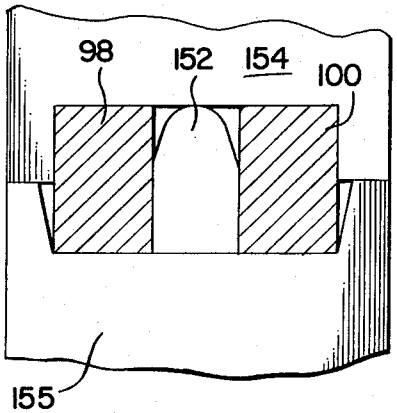
Figure 10B:
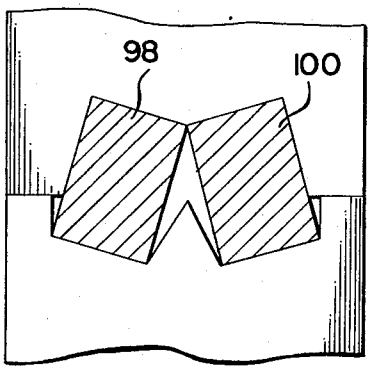
Figure 10A:
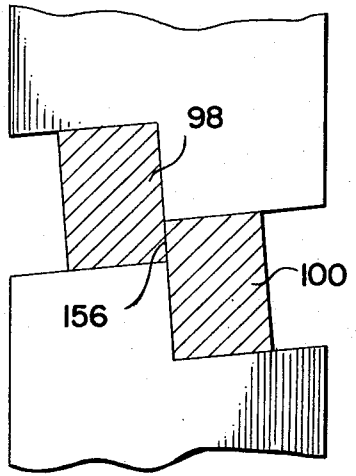

FIGS. 10*a* through 10*d* illustrate a fifth way of making the pin of this invention. As shown in FIG. 10*a*, the solid section 92 is severed on the bias to form the pieces 98 and 100. Contrary to the severing operation shown in FIG. 8*a*, the solid section 92 is not cut completely through. Nevertheless, there is a fracture line 156 which is equivalent to severing the solid section completely through. As illustrated in FIG. 10*b*, the next way work station consists of forming a butterfly similar to that shown in FIG. 9*c*. FIGS. 10*c* and 10*d* illustrate the same steps as shown in FIGS. 9*d* and 9*e*.

Note, that in accordance with the various methods of making the pin discussed above, all the die elements used to form the various segments of the pin move into and away from the plane of the metal strip 70. This is a simple, straightforward operation which does not require complicated machinery. If, for example, the severed pieces were spread apart by pushing against them laterally as taught in U.S. Pat. No. 4,206,964, complex camming equipment would be required. The method of this invention eliminates this camming equipment. This not only simplifies the manufacture of the pin, but, because stamping is conducted by moving the die elements towards and away from the plane of the strip, the rate at which the pins can be produced is substantially increased.

The above description presents the best mode contemplated of carrying out the present invention. This invention is, however, susceptible to modifications and alternate constructions from the embodiments shown in the drawing and described above. It is not the intention to limit this invention to the particular embodiments disclosed; but on the contrary, the invention is to cover all modifications, equivalencies, and alternate constructions falling within the spirit and scope of the invention as expressed in the appended claims.

What is claimed is:

1. An improved method for making an electrical contact pin from a generally flat strip of material, said pin having a shoulder segment, post segment, and, between the shoulder and post segments, a compliant segment which has a pair of outwardly biased beam members separated by an elongated opening having sharply pointed opposed ends, said method comprising the steps of:

(a) cutting generally spaced-apart aligned windows in the strip so that a solid section is provided between adjacent pairs of windows, the compliant segment of said pin being formed from this solid section;

(b) severing the solid section generally at right angles with respect to the longitudinal axis of the strip to form in the solid section a pair of metal pieces from which the beam members are made, one of said pieces moving in one direction away from the plane of the strip and the other piece moving in the opposite direction away from the plane of the strip;

(c) pressing the pair of metal pieces together so that they return to the plane of the strip and coining the edges of each metal piece furtherest from the severed interface;

(d) twisting the metal pieces to provide a generally V-shaped entryway between the severed interface of the pieces;

(e) inserting a first spreading element to move the metal pieces at a right angle to the plane of the strip to form the opening in the compliant section while coining the upper edges of the severed interface;

(f) inserting a second spreading element in an opposite direction from the insertion of the first spreading element to further coin the lower edges of the severed interface, and (g) forming from the strip, integral with the metal pieces, the shoulder and post segments of this pin.

2. An improved method for making an electrical contact pin from a generally flat strip of material, said pin having a shoulder segment, post segment, and, between the shoulder and post segments, a compliant segment which has a pair of outwardly biased beam members separated by an elongated opening, said method comprising the steps of:

(a) cutting generally spaced-apart aligned windows in the strip so that a solid section is provided between adjacent pairs of windows, the compliant segment of said pin being formed from this solid section;

(b) severing the solid section generally at right angles with respect to the longitudinal axis of the strip while simultaneously twisting the severed pieces about the longitudinal axis to form in the solid section a pair of metal pieces from whcih the beam members are made, one of said pieces moving in one direction away from the plane of the strip while rotating, and the other piece moving in the opposite direction away from the plane of the strip while rotating;

(c) pressing the pair of metal pieces so that they return to the plane of the strip while simultaneously spreading them to move the metal pieces at a right angle to the plane of the strip to form the opening in the compliant section, and (d) forming from the strip, integral with the metal pieces, the shoulder and post segments of this pin.

3. The invention of claim 2 further including the step of coining the edges of the metal pieces to provide rounded surfaces.

* * * * *